US005697102A

United States Patent [19]

Benjamin

[11] Patent Number: 5,697,102

[45] Date of Patent: Dec. 16, 1997

[54] COMBINATION TOWEL AND ROBE

[76] Inventor: Gary Benjamin, 501 N. Highland Ave., Los Angeles, Calif. 90036

[21] Appl. No.: 656,582

[22] Filed: May 31, 1996

[51] Int. Cl.[6] ..... A41D 3/08

[52] U.S. Cl. ..... 2/84; 2/69; 2/88

[58] Field of Search ..... 2/84, 69, 88, 89, 2/913, 48, 92, 104–106

[56] References Cited

U.S. PATENT DOCUMENTS

| | | | |
|---|---|---|---|
| 1,432,249 | 10/1922 | Hoyme . | |
| 1,497,685 | 6/1924 | Hoyme | 2/69 |
| 1,577,586 | 3/1926 | Morehouse . | |
| 1,901,223 | 3/1933 | Bush | 2/69 |
| 2,344,010 | 3/1944 | Walsh . | |
| 2,644,948 | 7/1953 | Gutmann | 2/69.5 |
| 3,013,274 | 12/1961 | Dike | 2/69 |
| 3,176,315 | 4/1965 | Freund | 2/69 |
| 3,381,306 | 5/1968 | Innes | 2/69 |
| 3,624,686 | 11/1971 | Beals | 2/48 |
| 4,484,362 | 11/1984 | Asher . | |
| 4,656,670 | 4/1987 | Schulter | 2/92 |

FOREIGN PATENT DOCUMENTS

| | | | |
|---|---|---|---|
| 451393 | 9/1949 | Italy | 2/84 |

*Primary Examiner*—Gloria Hale

*Attorney, Agent, or Firm*—Weingarten, Schurgin, Gagnebin & Hayes LLP

[57] ABSTRACT

A garment which may be employed as a robe or alternatively, as a towel, is disclosed. The garment comprises a generally rectangular piece of toweling material having a predetemined length and width wherein the length is greater than the width. A narrow slit extends in the direction of the length approximately midway across the width of the garment, thus providing an opening for the head of a wearer when the garment is worn as a robe. The article further includes a second piece of material which is attached to the garment and which serves as a hood when the garment is employed as robe. The second piece of material is sized and configured so as to allow it to cover the slit when the garment is used as a towel, such as a beach towel, to minimize user discomfort due to sand contact. Fasteners may be employed to releasably connect the sides of the garment when it is used as a robe.

23 Claims, 3 Drawing Sheets

COMBINATION TOWEL AND ROBE

FIELD OF THE INVENTION

The present invention relates generally to a multi-use garment and more particularly to a combination robe and towel.

BACKGROUND OF THE INVENTION

Robes which may also be employed as towels are known in the art. One combination robe/towel is disclosed in U.S. Pat. No. 4,656,670. The item therein described comprises a generally rectangular piece of fabric which has a slit extending across a portion of the width of the garment to form an opening for the head of a user. A flap is provided which covers the slit when the garment is being used as a beach towel.

Other combination beach robe and towel items are disclosed in U.S. Pat. Nos. 1,432,949, 1,497,685, 3,013,274, 3,176,315 and 3,381,306. A number of these prior art robes/towels include slits extending across the width of the garment or mechanical closures which abut the neck of a wearer and may cause discomfort. Garments employing mechanical closures for the head opening are likely to be uncomfortable when a user is employing the garment as either a robe or a towel since the opening usually falls squarely in the center of the towel. Other combination robes/towels provide a large opening for the head of wearer. While such an opening may be more comfortable for the wearer when the garment is used as a robe, it makes the item less desirable for use as a beach towel since it exposes the sand below.

SUMMARY OF THE INVENTION

A garment in the form of a combination robe and towel is disclosed. The garment comprises a first piece of absorbent material which is generally rectangular and which serves as the basic robe/towel body. The first piece of material has a predetermined length and width wherein the length is greater than the width. A lengthwise slit is provided approximately midway across the width of the first piece of material to allow a user's head to pass therethrough when the garment is worn as a robe. The garment also includes a second piece of material which is attached to the first piece of material and serves as a hood when the garment is worn as a robe and to cover the slit when the article is used as a beach towel. Releasable fasteners are provided to permit the garment sides to be attached together, when worn as a robe.

BRIEF DESCRIPTION OF THE DRAWINGS

The invention will be more fully understood from the following detailed description taken in conjunction with the accompanying drawings in which.

DETAILED DESCRIPTION OF THE INVENTION

Figure 1A:
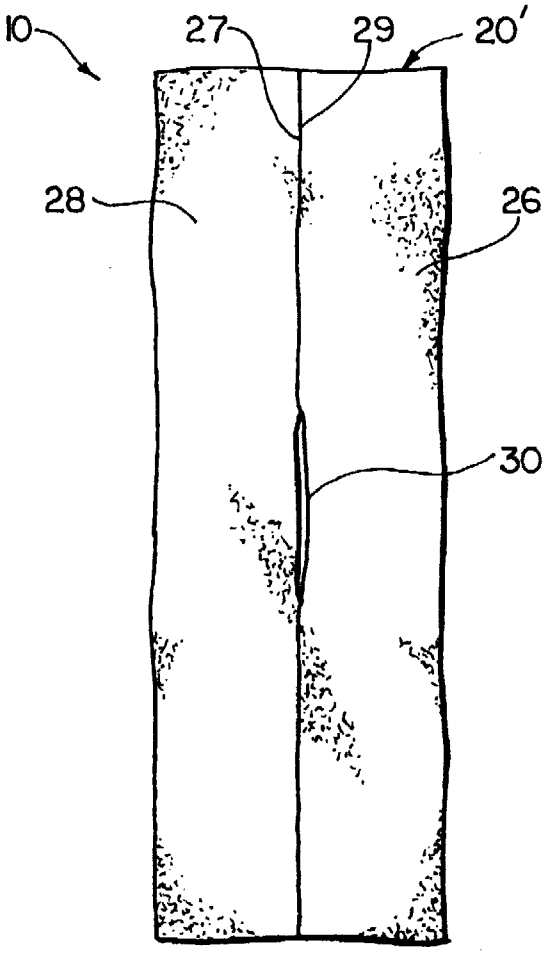
FIG. 1A is a diagram illustrating the first side of an alternate embodiment of the robe/towel body in accordance with the present invention.
Figure 1:
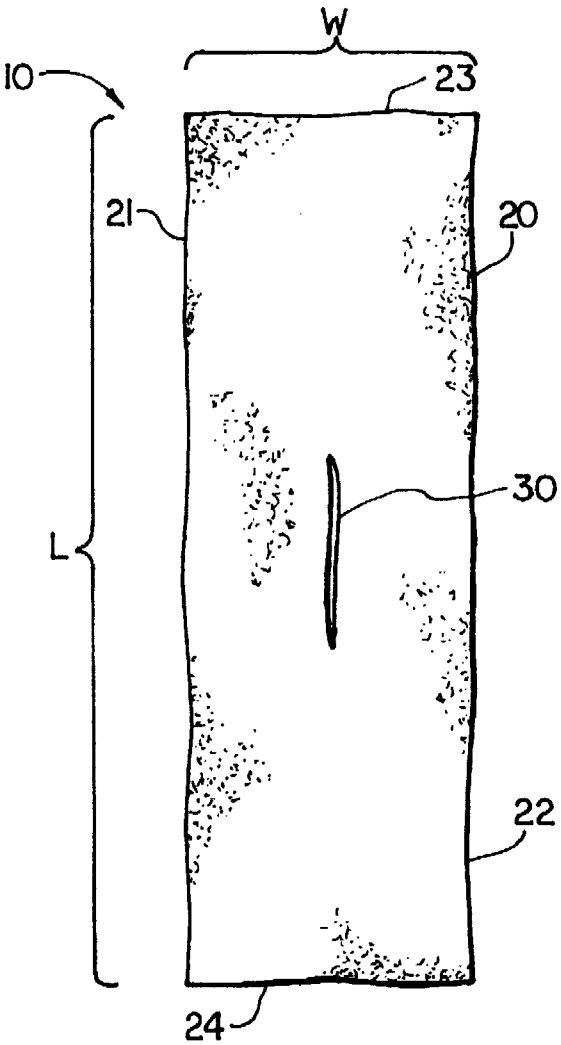
FIG. 1 is a diagram illustrating the first side of the robe/towel body in accordance with the present invention.

FIG. 1 illustrates the first side of the combination robe and towel 10. The first side of the robe constitutes the outside of the robe as normally worn by a wearer. The combination robe and towel 10 is made of terrycloth or any other suitable material and as illustrated in FIG. 1 the robe/towel body may be made from a single unitary piece of material 20. The piece of material or body 20 is generally rectangular and has a length (1) and a width (w) where the length is greater than the width. The body 20 has two opposing edges 21 and 22 which are generally parallel to each other, and two opposing ends 23 and 24 which are also generally parallel to each other. A slit 30 is provided in the central portion of the piece of material 20 and extends along a portion of the length of the body approximately midway between the opposing edges 21 and 22 of the body 20. Thus, the slit is generally parallel to the edges 21 and 22 of the body 20. The slit 30 is of sufficient length to allow a user's head to comfortably pass therethrough when the garment is worn as a robe. Optionally, a central border which extends the length of the robe and along each side of the slit 30 may be provided. The border provides for thicker material which yields additional comfort to the wearer as well as adding weight to the garment which aids in keeping the robe properly draped on the shoulders of the wearer.

In an alternate embodiment, illustrated in FIG. 1A, the rectangular piece of material or body 20' is comprised of two pieces of rectangular toweling material 26 and 28 which are joined together via a sewn seam or any other suitable technique to form the wider body 20'.

More specifically, the rectangular pieces 26 and 28 each have a length and a width wherein the length of the respective pieces 26 and 28 is greater than the combined width of both pieces of material 26 and 28. The pieces of material 26 and 28 are joined together along edges 27 and 29 of the respective pieces of material by sewing or any other suitable means, however, the two pieces of material are not joined together for a predetermined portion of the length so as to form a lengthwise slit 30 in the body 20'. In this manner the slit 30 may be provided during the manufacturing process simply by not joining the edges 27 and 29 of the pieces 26 and 28 together along the portion of the edges 27 and 29 where the slit 30 is to be located. A hem may be provided along the edge of the slit to finish the garment along the edge of the slit 30.

Figure 2:
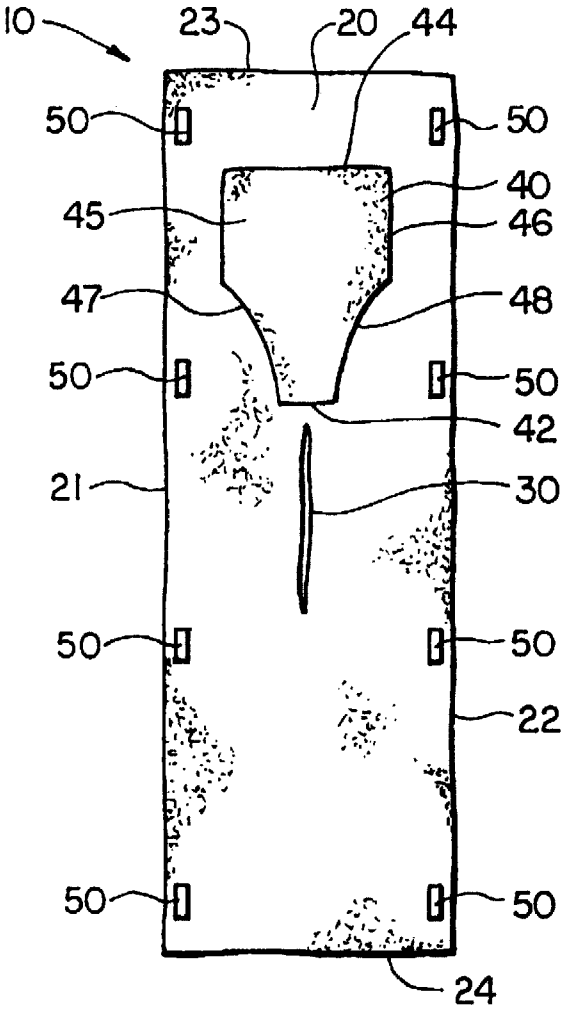
FIG. 2 is a diagram illustrating the second side of the combination robe and towel of the present invention.

FIG. 2 illustrates the second side of the combination towel and robe 10. As illustrated in FIG. 2, a plurality of releasably engageable fasteners 50 are provided adjacent the edges 21 and 22 of the piece of material 20. The realeasably engageable fasteners 50 allow for closure of the garment along the sides when the garment is worn as a robe.

Also as illustrated in FIG. 2 a second piece of material 40 is preferably attached to the second side of the first piece of material 20 along a fastening edge 42, although it should be appreciated that the second piece of material 40 could alternatively be attached to the first side of the first piece of material 20. The second piece of material 40 may be comprised of an absorbent toweling material, such as terrycloth, a non-absorbent fabric, or any other suitable material and is intended to serve as a hood when then garment is worn as a robe and to cover the slit 30 when the garment is employed as a beach towel. In the present embodiment, the second piece of material 40 has a fastening edge 42 and a front hood edge 44 opposing said fastening edge 42, and the fastening edge 42 is generally parallel to the front hood edge 44. Opposed sides 45 and 46 extend from the front hood edge 44 toward the fastening edge 42. Two curvilinear edges 47 and 48 extend from respective sides 45 and 46 to the fastening edge 42. While a particular shape is disclosed, it should be appreciated that any suitable shape may be employed which allows the material to cover the head of a wearer when the garment is worn as a robe and which serves to cover the slit 30 along the entirely of its length when the garment is used as a towel.

The second piece of material 40 may be permanently fastened to the first piece of material 20 along the fastening edge 42 of the second piece of material 40 adjacent an end of the slit 30 by sewing, gluing or any other suitable permanent fastening means so as to permit the second piece of material 40 to be positioned over and thereby cover the slit 30 when the garment is used as a towel. Alternatively, the second piece of material 40 may be disengageably fastened to the first piece of material 20 with hook and loop fasteners or any other suitable fasteners so as to permit the second piece of material 40 to be removed when the garment is worn as a robe, should the wearer so desire.

Fasteners 50 are selectively positioned and fastened to the material 20 adjacent the edges 21 and 22 of the material 20 and may comprise hook and loop fasteners, snaps, buttons or any other suitable releasably engageable fasteners known in the art. The fasteners 50 may releasably engage each other, or may releasably engage the toweling material.

Figure 3:
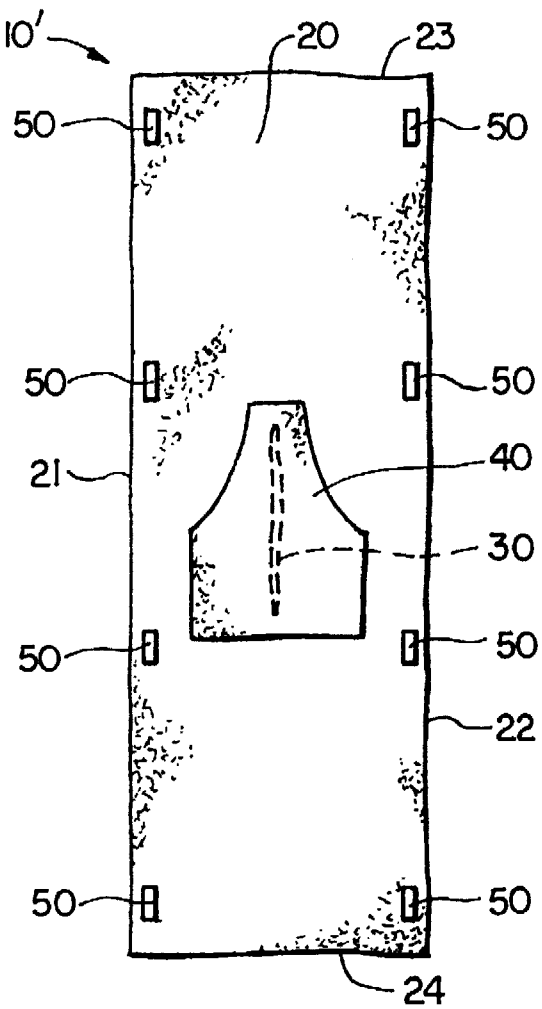
FIG. 3 is a diagram of the combination robe and towel used as a towel.

FIG. 3 illustrates the robe/towel 10' extended its full length as it would be when employed as a beach towel. As indicated above, the second piece of material 40 may be either permanently attached to the piece of material 20 or disengageable from the piece material 20. When the garment is used as a beach towel, as illustrated in FIG. 3, the second piece of material 40 is disposed so as to completely cover the slit 30 and thereby minimize the discomfort of sand to a user. More specifically, the second piece of material 40 functions to isolate the user from any sand that may pass through the slit 30, were the slit 30 uncovered. Additional disengageable seams may be provided along the edges of the second piece of material 40 to releasably attach the second piece of material along its edges to the first piece of material 20 in order to further minimize the likelihood of sand contact when the garment is used as a beach towel. In the above described manner, the towel 10' minimizes discomfort due to the passage of sand to the top side of the towel. Additionally, it is noted that since the second piece of material 40 covers the slit 30, the user is not subjected to the discomfort that would result when lying upon the towel if zippers, snaps or other bulky fasteners were employed to seal the slit 30.

Figure 4:
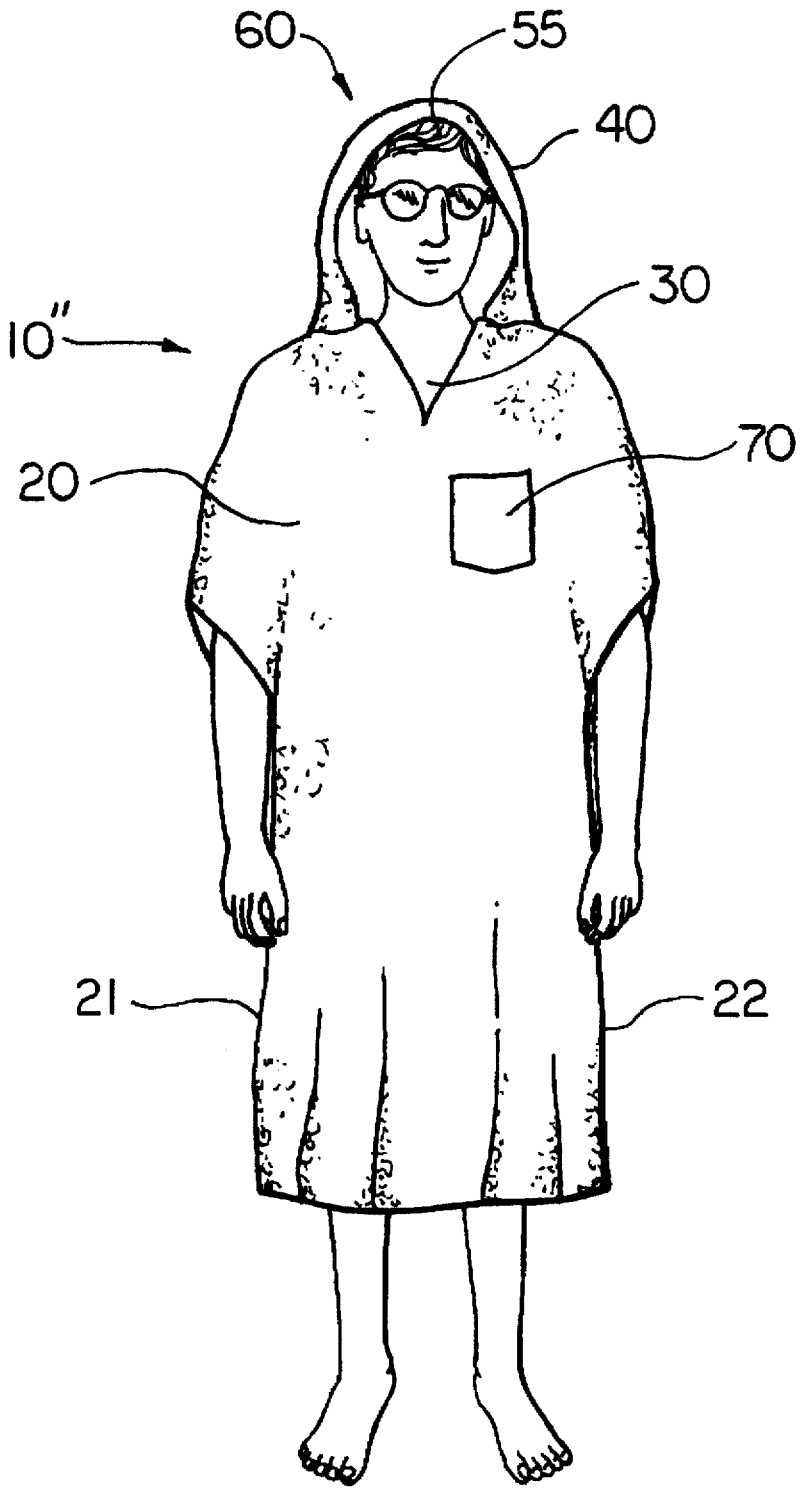
FIG. 4 is a diagram of a user wearing the combination robe and towel as a robe.

FIG. 4 illustrates the garment being used as a robe 10". As illustrated in FIG. 4, the user's head 55 extends through the slit 30 of the robe 10".The side 21 is releasably attached to an opposite facing section of the same side 21 by engagement of fasteners 50. Similarly, a section of the side 22 is releasably attached to an opposite facing section of the same side 22 by engagement of fasteners 50, thereby closing the robe about the user 60.

The second piece of material 40 passes through the slit 30 and is draped over the user's head 55 to serve as a hood. By passing the second piece of material through the slit, the hood thus formed may be draped over the user's head and provides added comfort and protection in the rear neck region. Alternately, the hood may be draped around the neck, serving as a collar to provide comfort and protection for the neck area. Additionally, a pocket or pockets 70 may be permanently or removably attached to the robe 10". The pocket may be disposed at any location along the garment, and preferably on an inside surface, at a position below the ribcage on the left hand side of the wearer.

It will apparent to those of ordinary skill in the art that other embodiments incorporating the identified concepts may be used without departing from the inventive concepts disclosed herein. Accordingly, the invention should not be limited to the described embodiments but rather should be limited only by the scope and spirit of the appended claims.

I claim:

1. A combination robe and towel comprising:

a first piece of toweling material having a first side, a second side, a length and a width, said first piece of toweling material having first and second edges extending the length of the material and first and second ends extending the width of the material, wherein said length is greater than said width;

said first piece of toweling material having first and second interior edges defining a slit therein disposed centrally along a portion of said length, said first and second interior edges having common first and second ends corresponding to first and second ends of said slit, said slit extending generally parallel to said first and second edges and having a length sufficient to allow a wearer's head to pass therethrough;

said first and second interior edges being disposed in substantially abutting relation when one of said first and second sides of said first piece of toweling material is disposed in abutting relation with a generally planar surface;

a second piece of material sized and configured to form a hood to cover the head of a wearer, said second piece of material having a first fastening edge fastened to said first piece of toweling material adjacent one end of said slit;

said second piece of material having a length sufficient to cover said slit when said second piece of material is disposed in abutting relation with said first piece of toweling material and over said slit.

2. The combination robe and towel of claim 1 wherein said second piece of material comprises toweling material.

3. The combination robe and towel of claim 1 further comprising a pocket removably attachable to said combination robe and towel.

4. The combination robe and towel of claim 1 wherein said second piece of material is removably fastened to said first piece of toweling material with hook and loop fasteners attached to said first and second pieces of material respectively.

5. The combination robe and towel of claim 1 wherein said second piece of material is removably fastened to said first piece of toweling material.

6. The combination robe and towel of claim 1 wherein said second piece of material has first and second sides and is configured such that said second piece of material may be positioned in substantially flat abutting relation with said first piece of toweling material and over said slit when one side of said first piece of toweling material is disposed in substantially planar abutting relation with a flat surface.

7. The combination robe and towel of claim 1 wherein said first piece of toweling material is generally rectangular and has first and second generally parallel edges extending the length of the material and first and second generally parallel ends extending the width of the material.

8. The combination robe and towel of claim 1 further including a plurality of fasteners attached to said first piece of toweling material adjacent respective first and second edges thereof such that each fastening member is generally disposed in opposed mating relation with a mating fastening member when said combination robe and towel is being worn by a wearer.

9. The combination robe and towel of claim 8 wherein said plurality of fasteners comprise hook and loop fasteners attached to said first piece of toweling material adjacent first and second edges respectively.

10. A combination robe and towel comprising:

a first piece of toweling material having a length and a width, said first piece of toweling material being generally rectangular and having first and second generally parallel edges extending the length of the material and first and second generally parallel ends extending the width of the material, wherein said length is greater than said width;

said first piece of toweling material having a slit disposed centrally therein along a portion of said length, said slit extending generally parallel to said first and second edges and having a length sufficient to allow a wearer's head to pass therethrough;

a second piece of material sized and configured to form a hood to cover the head of a wearer, said second piece of material having a first fastening edge fastened to said first piece of toweling material adjacent one end of said slit;

said second piece of material having a length sufficient to cover said slit when said second piece of material is disposed in abutting relation with said first piece of toweling material and over said slit;

wherein said first piece of toweling material is formed of first and second subsections of material, each of said first and second subsections having an inner edge and an outer edge and first and second ends, said first and second subsections having a seam joining the respective inner edges of said subsections along a portion of the respective inner edges so as to provide the centrally disposed slit.

11. The combination robe and towel of claim 10 wherein said second piece of material comprises toweling material.

12. The combination robe and towel of claim 10 further comprising a pocket removably attachable to said combination robe and towel.

13. The combination robe and towel of claim 10 further including a plurality of fasteners attached to said first piece of toweling material adjacent respective first and second edges thereof such that each fastening member is generally disposed in opposed mating relation with a mating fastening member when said combination robe and towel is being worn by a wearer.

14. The combination robe and towel of claim 13 wherein said plurality of fasteners comprise hook and loop fasteners attached to said piece of toweling material adjacent first and second edges respectively.

15. The combination robe and towel of claim 10 wherein said second piece of material is removably fastened to said first piece of toweling material.

16. The combination robe and towel of claim 15 wherein said second piece of material is removably fastened to said first piece of toweling material with hook and loop fasteners attached to said first and second pieces of material respectively.

17. A combination robe and towel comprising:

a first piece of toweling material having a length and a width, said first piece of toweling material being generally rectangular and having first and second generally parallel edges extending the length of the material and first and second generally parallel ends extending the width of the material, wherein said length is greater than said width;

said first piece of toweling material having a slit disposed centrally therein along a portion of said length, said slit extending generally parallel to said first and second edges and having a length sufficient to allow a wearer's head to pass therethrough;

a second piece of material sized and configured to form a hood to cover the head of a wearer, said second piece of material having a first fastening edge fastened to said first piece of toweling material adjacent one end of said slit;

said second piece of material having a length sufficient to cover said slit when said second piece of material is disposed in abutting relation with said first piece of toweling material and over said slit;

wherein said first piece of toweling material has a first side and a second side, said second piece of material having a hood portion, said fastening edge of said second piece of material being fastened to said second side of said first piece of toweling material adjacent one end of said slit, said second piece of material being configured such that said hood portion may extend through said slit to said first side of said first piece of material and cover the head of a wearer when said combination robe and towel is being worn as a robe.

18. The combination robe and towel of claim 17 further including a plurality of fasteners attached to said first piece of toweling material adjacent respective first and second edges thereof such that each fastening member is generally disposed in opposed mating relation with a mating fastening member when said combination robe and towel is being worn by a wearer.

19. The combination robe and towel of claim 18 wherein said plurality of fasteners comprise hook and loop fasteners attached to said piece of toweling material adjacent first and second edges respectively.

20. The combination robe and towel of claim 17 wherein said second piece of material is removably fastened to said first piece of toweling material.

21. The combination robe and towel of claim 20 wherein said second piece of material is removably fastened to said first piece of toweling material with hook and loop fasteners attached to said first and second pieces of material respectively.

22. The combination robe and towel of claim 17 further comprising a pocket removably attachable to said combination robe and towel.

23. The combination robe and towel of claim 17 wherein said second piece of material comprises toweling material.

* * * * *